United States Patent [19]

Engl

[11] 4,343,440

[45] Aug. 10, 1982

[54] ADDITIONAL DEVICE FOR ROLLING INSTALLATIONS AND PROCEDURES FOR ROLLING OF PRESSURE-SENSITIVE MATERIALS

[75] Inventor: Rupert Engl, Bergisch Gladbach, Fed. Rep. of Germany

[73] Assignee: Zanders Feinpapiere AG, Bergisch Gladbach, Fed. Rep. of Germany

[21] Appl. No.: 184,016

[22] Filed: Sep. 4, 1980

[30] Foreign Application Priority Data

Sep. 5, 1979 [DE] Fed. Rep. of Germany ..... 2935743

[51] Int. Cl.[3] ..... B65H 17/02

[52] U.S. Cl. ..... 242/67.1 R; 242/67.2

[58] Field of Search ..... 242/67.2, 67.1 R, 67.3 R, 242/56 A

[56] References Cited

U.S. PATENT DOCUMENTS

| | | | |
|---|---|---|---|
| 3,387,798 | 6/1968 | Young | 242/67.1 R |
| 3,410,499 | 11/1968 | Schmidt | 242/67.1 R |
| 3,602,448 | 8/1971 | Muensterer | 242/67.1 |
| 3,670,980 | 6/1972 | Mukai | 242/67.1 R |
| 3,749,328 | 7/1973 | Dusenbery | 242/67.1 R |

FOREIGN PATENT DOCUMENTS

| | | |
|---|---|---|
| 1136880 | 9/1962 | Fed. Rep. of Germany . |
| 1560039 | 9/1969 | Fed. Rep. of Germany . |
| 1920455 | 7/1972 | Fed. Rep. of Germany . |
| 2037979 | 3/1977 | Fed. Rep. of Germany . |
| 1091967 | 11/1967 | United Kingdom . |

*Primary Examiner*—Edward J. McCarthy
*Attorney, Agent, or Firm*—Keil & Witherspoon

[57] ABSTRACT

An auxiliary device on devices for winding a weblike material into rolls, the quality of winding being distinctly improved, and a process for winding weblike material into rolls. In addition to the known first contact (feed) roll, the device also has a second, soft-surface contact roll the pressure of application of which can be precisely adjusted. The pressure of application of the second contact roll is transmitted by a pneumatic cylinder or a pneumatic pressure control valve, lever arms. As the diameter of the roll increases, the movement of the contact roll or the lever arms is used to generate a pulse via a contact device, so that the position of the first contact roll in relation to the roll being formed, i.e., the gap is kept constant by way of an auxiliary drive.

The device and the process according to invention are particularly well suited for winding pressure-sensitive web materials into rolls. In winding weblike material into rolls with the device according to the invention, a gap is maintained between the first contact roll and the roll being formed, the angle of approach of the web is kept constant, and the second contact roll is applied to the roll being formed at a point beyond the point of arrival of the web, in order to expel the air contained between the roll being formed and the web which is just arriving.

10 Claims, 2 Drawing Figures

ADDITIONAL DEVICE FOR ROLLING INSTALLATIONS AND PROCEDURES FOR ROLLING OF PRESSURE-SENSITIVE MATERIALS

BACKGROUND OF THE INVENTION (a) Field of the Invention

The invention concerns an auxiliary device on devices for rolling up weblike material to form rolls so as to preserve the quality of the paper and to improve the winding quality, and also concerns a process of rolling up weblike material. The device and process according to the invention are particularly well suited for the processing of pressure-sensitive material webs. In particular, webs of pressure-sensitive chemically reactive carbon paper can be processed by means of them to form rolls in proper condition.

The quality of winding of rolls of weblike material affects the possiblity of subsequent processing. Various factors are decisive in evaluating the winding quality of a roll:

The layer pressure between the layers of paper generated by the winding traction; the residual tension in the interior of the roll, in connection with which it is to be remembered that part of the winding tension is reduced by the layer pressure of the outer layers; and the winding tension, which depends on the propulsive power of the winding shaft, the pressure of application of the roll to be wound to the roll core or sleeve, and the pressure of any pressure roll employed.

An effort is exerted on the one hand to wind rolls which are as hard as possible, since if the core in particular is wound too loosely, core layers can be displaced laterally outward and the web to be unwound subsequently is difficult to control in the lateral guide. On the other hand, sensitive web materials such as coated papers the coating of which contains pressure-sensitive microcapsules do not allow of high winding tension, since the layer pressure in the interior may not exceed specific values; otherwise the pressure results in premature damage to the capsules which lowers the quality of the material for its proper use. If the tension is too high, local overelongations leading to so-called tension grooves may also occur. These deformations of the paper web represent an impairment of the quality of the paper and also make the paper unusable.

Improvement in the quality of winding by application of the state-of-the-art pressure rolls with hard surfaces is not possible in the case of pressure-sensitive web materials. This quality is prematurely destroyed by the pressure applied in the case of coatings containing pressure-sensitive microcapsules. It is necessary in such cases to operate any state-of-the-art pressure (feed) rolls present on the wind-up turrets with a gap. The air drawn in between the individual layers at high machine speeds with this mode of operation is not removed. The contained air causes permanent local deformation of the web, a deformation conforming to the shape of the air cushion, under the pressure applied by the web. If contained air is present over a large area, lateral displacement of the roll is inventive. The quality of the web is greatly impaired in both instances. For example, it is absolutely necessary for pressure-sensitive chemically reactive carbon papers to have smooth, flat sheets of paper in which the microcapsules contained in certain coatings are undamaged.

The same problems occur, however, not alone with paper webs of widely varying nature, but also for example in the rolling up of thin sheets of readily deformable plastic.

(b) Description of the Prior Art

It has in the past been possible to master this problem to a certain extent only by greatly reducing the external diameter of the rolls. Rolls of greater external diameter are nevertheless required in order to achieve longer machine operation periods without roll replacement by means of greater web lengths.

DT-OS No. 24 39 212 discloses a device and a process for improvement in the quality of winding in the case of paper rolls with a large external diameter. Winding of the roll under tension results in compression of the paper leading to reduction of the thickness of the paper. The difference in thickness between the arriving weblike material and the average thickness of the wound layers is determined and is employed as a reference quantity for control of the winding mechanism. This device makes it possible to wind light-weight coated papers (LWC papers), in particular, into hard rolls of great external diameter without causing breaks in the web. This process is not, however, suitable for pressure-sensitive web materials such as papers with coatings containing pressure-sensitive microcapsules, since such materials must be wound in such a way that the web is not measurably compressed by the winding.

DE-OS No. 25 41 945 as well discloses a method of regulating the contact pressure of a contact roller. In the case of this automatic control the contact pressure is used among other things as a control factor and an attempt is made to solve the problem by means of expensive electronic equipment.

DE-AS No. 21 01 032 discloses a device by means of which dual layer sheet material can be separated and wound up separately.

The web of material is guided over a smoothing roller to the appropriate wind-up roller. This smoothing roller is applied to the wind-up roller under pressure of the lowest possible value so that any air between adjacent web layers inside the winding is removed. The smoothing roller is mounted so as to be rotatable about a swivel axis so that the pressure applied to the two sides can be independently adjusted in order to equalize slightly different roll diameters on the two sides of the wind-up roll. Pivoting movements of the wind-up roll in keeping with the increasing roll diameter are initiated mechanically by way of special elements mounted on the pivoting axis, ones which operate in conjunction with pins mounted on the support arms of the smoothing roller.

OBJECTS AND SUMMARY OF THE INVENTION

On the basis of this state of the art, which does not as yet yield fully satisfactory results, the aim of this invention is creation of a simple auxiliary device on devices for winding up weblike material into rolls of greater external diameter and of better winding quality, for sensitive weblike material, and in particular materials which are sensitive to pressure.

Another aim of the device according to the invention is to subject the arriving web only to a pressure such as will not impair the quality but will nevertheless present air inclusions.

An additional aim of the invention is to employ a simple auxiliary device to permit control of an auxiliary drive continuing to rotate the turnstile of a winding device so long that a gap remains between the state-of-the-art pressure roller and the roll being formed and the angle of approach of the web of material to the roll remains constant. In the case of wind-up turrets with a stationary winding axis, the aim of the auxiliary device according to the invention is to make possible control of an auxiliary drive which moves the two pressure rolls in such a way that a gap is maintained between the first contact roll and the roll being formed and the angle of approach of the material web to the roll remains constant.

The aim of the process according to the invention is to ensure the winding of pressure-sensitive weblike material into rolls of greater external diameter accompanied by acceptable product quality and adequate winding quality.

The aim has been reached by means of an auxiliary device on devices for the winding of weblike material into rolls with a first feed (contact) roll, said auxiliary device being characterized by a second contact roll having a soft surface and being applied by way of lever arms to the roll being formed, it being possible to adjust with precision the pressure of application of this second contact roll; devices acting on the other ends of the lever arms for control of the pressure of application of the second contact roll; an auxiliary drive for imparting movement to the roll being formed or the support devices of the contact rolls to create a gap between the first contact roll and the roll being formed; and a contact device to be triggered by one of the lever arms for control of the auxiliary drive.

In a preferred embodiment the second contact roll has a hard core and a soft surface cover. Soft foam plastics are particularly well suited for use as the surface cover.

A characteristic of one embodiment of the device according to the invention is that the point of application of the contact roll to the roll being formed is situated 40–50 mm beyond the point of arrival of the paper web at the roll.

In another embodiment of the device according to the invention, at least one of the lever arms is formed and arranged so that the movements of the lever arms caused by a slight increase in the diameter of the roll being formed trigger the contact device, and the lever arms return to the initial position as a result of change in the position of the roll being formed or change in the position of the contact rolls.

Preference is given to pneumatic cylinders for the devices acting on the other ends of the lever arms. In principle, however, use may also be made of hydraulic cylinders. The apparatus expenditure for hydraulic devices is, however, greater than that for pneumatic cylinders, so that preference is given to the latter.

The invention also relates to a process for the winding of pressure-sensitive weblike material into rolls in the devices according to the invention, in which process a gap is maintained between the first contact roll and the roll being formed, the angle of approach of the material web to the roll being formed is kept constant, a second counter roll is applied with slight pressure to the roll being formed at a point beyond the point of arrival of the web, and air contained between the roll being formed and the web just approaching is expelled by means of this second contact roll.

A preferred procedure is characterized by the fact that the pressure of application of the second contact roll is set by pneumatic cylinders at such a low value that no damage to the material occurs as a result of pressure.

The devices and the process according to the invention are particularly well suited for the winding of pressure-sensitive weblike materials into rolls. One such material is represented by pressure-sensitive chemically reactive carbon paper. Such papers have coatings containing microcapsules which during use are broken and release the contents. Premature breaking of the capsules in manufacture and processing of the coated paper webs must be prevented at all costs. In the past it has been possible to wind such papers, on coating machines, for example into rolls having diameters of only about 80 cm, so that frequent roll replacement has been necessary at the currently customary machine speeds. Use of the auxiliary devices according to the invention and application of the process claimed for the invention make it possible to wind such papers into rolls of acceptable quality and having external diameters ranging from 120 to 150 cm. Even larger diameters can in principle be achieved, but the customary state-of-the-art wind-up turrets often are not designed for larger roll diameters.

The auxiliary devices according to the invention may be mounted on wind-up turrets with a stationary or mobile winding axis. In the case of rolls with a stationary winding axis, that is, in an arrangement in which the winding axis is fixed in one position, the device according to the invention and the mounting support of the first contact roll are actuated by the auxiliary drive and are controlled in such a way that a gap is maintained between the first contact roll and the roll being formed.

BRIEF DESCRIPTION OF THE DRAWINGS

The preferred embodiments of the invention will now be described with reference to the accompanying drawings in which.

DESCRIPTION OF THE EMBODIMENTS

Figure 1:
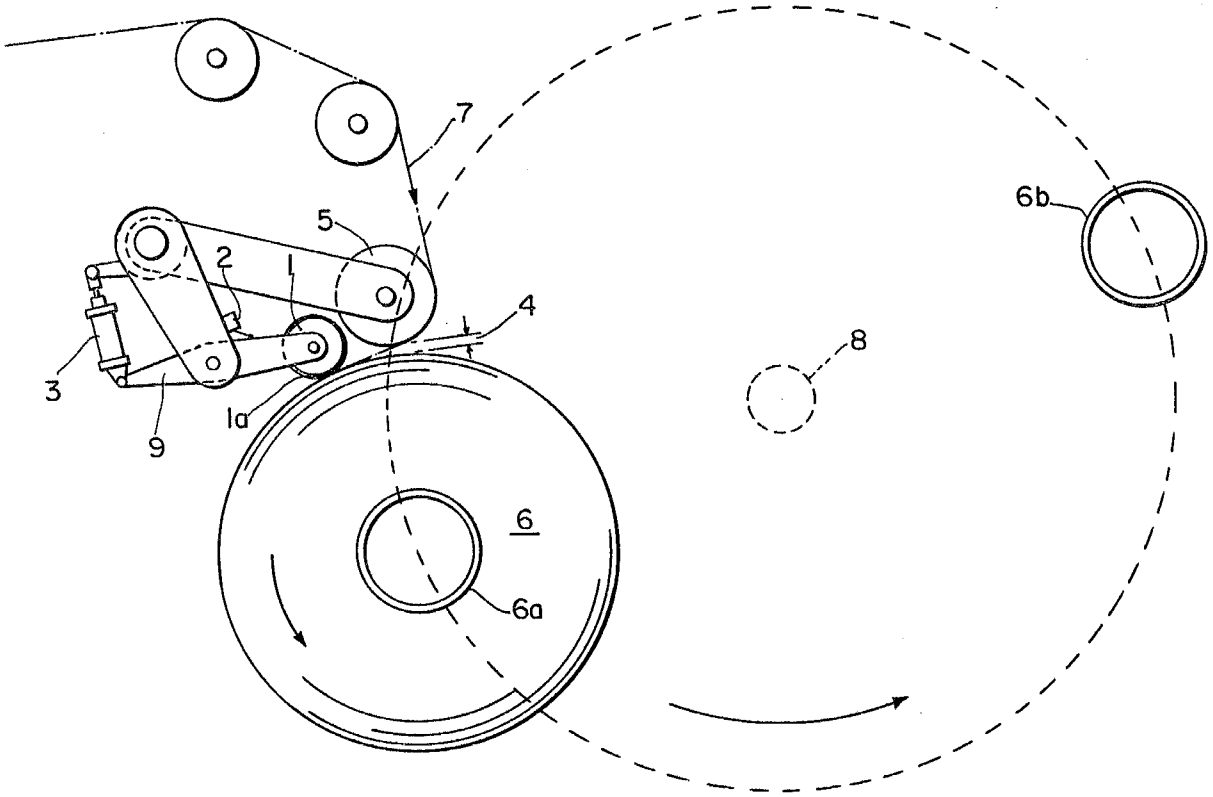
FIG. 1 is a top view of an arrangement according to the invention, in which the winding axis of the apparatus is movable.

The invention is illustrated in greater detail in FIG. 1, through the example of embodiment Example 1 with mobile winding axis. The material web 7 is wound by means of a wind-up turret to form a roll 6. The core of the roll, in the form of a winding shell, is designated by *6a*. *6b* denotes another winding axis mounted on the turnstile. A gap 4 is set between the state-of-the-art contact roll 5 and the roll to be wound 6. The second contact roll 1, which may also be designated an air expulsion roll, with soft surface cover *1a*, rests with almost no weight on the roll to be wound 6, because of relief of pressure by the pneumatic cylinder 3, by way of lever arms 9, and expels air from the arriving material web 7. Increase in the diameter of the roll 6 during winding causes contact roll 1 to be pressed against a switch 2, which activates an auxiliary drive and continues to rotate the turnstile 8 of the wind-up turret in the direction of the arrow until the switch 2 is again clear. As a result of this control, a virtually constant gap 4 is set for the contact roll 5 and the angle of approach of the material web 7 to the roll 6 is kept constant.

The width required for the gap 4 depends among other things on the material of the web and on the winding speed. The width of the gap may range from 1 to 50 mm. Widths ranging from 2 to 15 mm are preferable. Gap widths of 4–5 mm are particularly well suited for web materials such as chemically reactive pressure-sensitive carbon papers. The applicable gap widths also fall within the range indicated above for other papers or materials such as sheet plastic.

Figure 2:
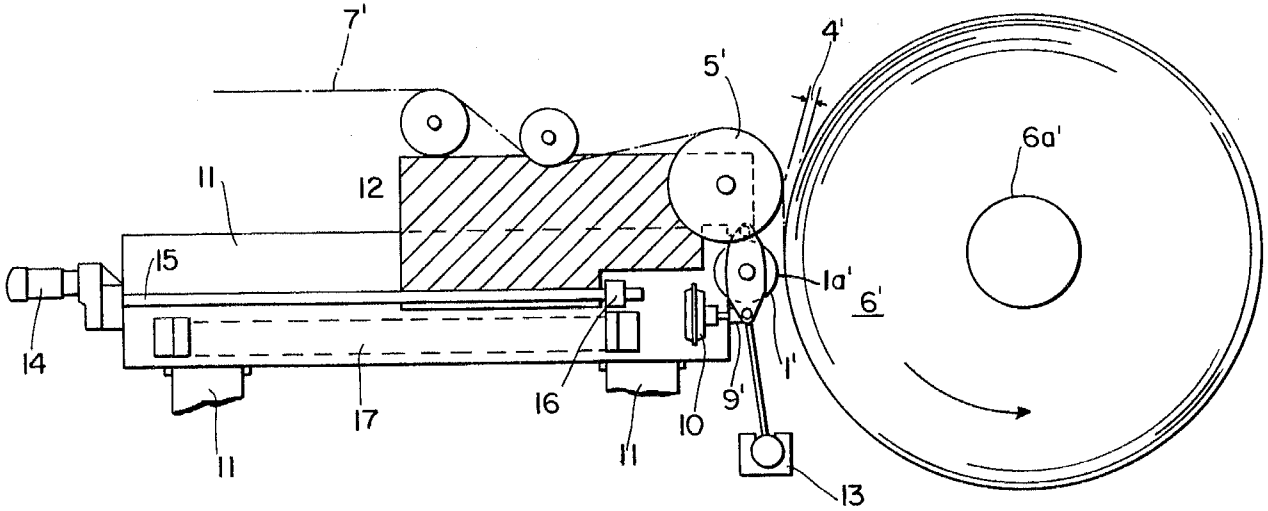
FIG. 2 is the top view of an arrangement according to the invention, in which the winding axis of the apparatus is stationary.

Example 2, shown in FIG. 2, illustrates another embodiment, in which the winding axis is stationary. The material web 7' is wound in a wind-up turret into a roll 6'. The core of the roll, in the form of a winding shell, is designated by 6a'.

A gap 4' is set between the state-of-the-art contact roll 5' (first contact roll) and the roll to be wound 6'. The second contact roll 1', with soft cover, rests with almost no weight on the roll to be wound 6', because of relief of pressure by membrane cylinder 10 on lever arm 9', and expels air from the arriving material web 7'.

The auxiliary device consists in this example of an easy-action carriage 12 forcibly guided in parallel and mounted horizontally on two support elements 11. This carriage bears a number of rolls performing different functions. While the first three rolls, including the first contact roll 5', serves the purpose exclusively of guiding the material web, application of pressure to the paper roll is in this example effected by way of the second contact roll 1' embodied as an oscillating roll, which is pneumatically loaded by two membrane cylinders 10. The pressure applied is set by way of a pneumatic pressure control valve. The geometric position selected for oscillating roll 1' relative to paper roll 6' ensures that the material web 7' reaches the paper roll 6' before it is pressed against the paper roll 6' by the oscillating roll 1', and that the application pressure set remains constant over the winding range in question.

An inductive displacement pickup 13 is pivotally mounted on oscillating roll 1' to detect increase in the diameter of the roll 6'. It is expedient to effect the pivot mounting on lever arm 9. This pivot mounted inductive displacement pickup corresponds to the switch 2 in example 1 and acts as a pulse generator. The output signal of this displacement pickup 13 is transmitted by way of a PI regulator not shown for control of a direct current servomotor 14, which by way of a spindle 15 with nut 16 moves the carriage 12 away from the roll 6 continuously and simultaneously with increase in the diameter of the roll 6', so that the gap between the first contact roll 5 and the roll being formed 6' remains just as constant as does the pressure of application of the oscillating roll 1' to the roll 6'.

The carriage 12 is pressed against the adjusting nut 16 by two pneumatic cylinders 17. No rigid connection exists between nut 16 and carriage 12. Consequently, the carriage 12 can be moved rapidly away from the roll of material 6' by pneumatic means in any operating condition. Positional adjustment is in this case disengaged by appropriate electric control and the adjusting nut 16 is secured in its instantaneous position in a manner not particularly shown. If the carriage 12 is moved against the roll 6' by the two pneumatic cylinders 17, the positional control is engaged by limit switches when the oscillating roll 1' is applied to the roll 6'.

When the control device is engaged, initially the nut 16 is moved to the end position by way of spindle 15 without movement of the carriage in the direction of the roll to be wound 6', and only then is the carriage 12 moved in the direction of the roll 6' by means of the pneumatic cylinders 17, until the second contact roll 1' (oscillating roll) comes into contact with the roll to be formed. The slight pressure applied is produced by the lever 9' of membrane cylinder 10, which is charged with a preselected air pressure.

The particular advantage of the subject of this application lies in the circumstance that wind-up turrets produced by known manufacturers and currently in operation can be equipped with the auxiliary device according to the invention, so that the operational potential of such wind-up turrets can be improved. The device, which is simple in structure, requires no major additional expenditure and is dependable and virtually maintenance-free in operation. The considerable cost of electronic control can be avoided by means of the subject of this invention.

It goes without saying that devices incorporating the subject of the invention can also be used to wind up webs which do not consist of pressure-sensitive material, so that the auxiliary device need not be removed when material webs which can be subjected to higher stress are to be wound.

The process according to the invention involves a mode of operation of the device according to the invention which is by no means self-evident. This process is especially well suited for winding webs of material extremely sensitive to pressure into rolls of large diameter. As has already been stated, this process is by preference especially well suited for the winding up of webs coated with pressure-sensitive microcapsules. The particular advantage lies in the circumstance that the destruction of the material which results from application of too heavy a pressure load but which is not detectable in winding of the rolls is definitely avoided.

LIST OF REFERENCE NUMBERS

1'. Second contact roll, air removal roll, oscillating roll
1a. Soft surface covering of air removal roll
2. Contact device, switch
3. Pneumatic cylinder
4'. Gap between roll being formed and first contact roll
5'. First contact roll
6'. Roll to be wound
6a'. Roll core (shell)
6b. Empty roll core
7'. Material web
8. Axis of wind-up device turnstile
9'. Lever arm
10. Membrane cylinder
11. Support elements
12. Carriage
13. Inductive displacement pickup, pulse generator
14. Servomotor
15. Spindle
16. Nut, adjusting nut
17. Pneumatic cylinder

I claim:

1. An auxiliary winding control device for use with an apparatus for winding web-like material up to form a roll, said apparatus having a web contacting roller, said auxiliary device comprising:

another web contacting roller having a soft surface;

pivoted lever means for displaceably supporting said other roller for rotation;

means connected to said lever means for urging said other roller with a predetermined pressure against said wind-up roll;

means for varying the relative distance between said wind-up roll on the one hand and the first-mentioned roller and the pivot of said lever means on the other hand; and contact means linked to said lever means and responsive to the displacement of said other rollers by said wind-up roll incident to the winding operation, for controlling said distance-varying means so as to maintain a predetermined gap between said first-mentioned roller and said wind-up roll.

2. The device as claimed in claim 1, wherein said other roller has a hard core and a soft surface coating.

3. The device as claimed in claim 1, wherein the point of application of said other roller to the wind-up roll is about 40 to 50 mm. behind the point of arrival of the web-like material on the wind-up roll.

4. The device as claimed in claim 1, 2 or 3, wherein said lever means is of a design such that pivoting movement of said lever means caused by a slight increase in the diameter of the wind-up roll and the corresponding displacement of said other roller actuates said contact means, said lever means being permitted to return to their initial position in response to the ensuing increase in the relative distance between said wind-up roll and said pivot point.

5. The device as claimed in claim 1, wherein said urging means is of the fluid-actuated type.

6. The device as claimed in claim 1, wherein the axis of said first roller and also the pivot point of said lever means are stationary whereas the axis of said wind-up roll is mounted for movement relatively to said first-mentioned axis and said pivot point.

7. The device as claimed in claim 6, wherein said wind-up roll is mounted for orbital rotation, as well as rotation about its axis, on a turnstile.

8. The device as claimed in claim 1, wherein the axis of said wind-up roll is relatively stationary, whereas a common movable support is provided for said first roller and said pivoted lever means.

9. A process for winding pressure-sensitive web-like material up to form a roll, comprising:

providing two web contacting rollers, the first roller spaced from the wind-up roll so that said first roller acts as a guide roller;

urging the second roller against the wind-up roll with a slight pressure at a location beyond the point of arrival of the web on the wind-up roll so as to expel the air contained between the wind-up roll and the layer of web material just being wound up; and maintaining, in response to the displacement of said second roller by the increase in diameter of the wind-up roll, the spacing between said first roller and said wind-up roll, and also the angle of feed of the web onto the wind-up roll at a substantially constant value.

10. A process as claimed in claim 9, wherein said urging step includes pneumatically applying said second roller to said wind-up roll with a pressure set so low that no damage to the material occurs as a result of said pressure.

* * * * *